US011011301B2

(12) United States Patent
Sato et al.

(10) Patent No.: US 11,011,301 B2
(45) Date of Patent: May 18, 2021

(54) MAGNETIC COUPLING COIL COMPONENT

(71) Applicant: TAIYO YUDEN CO., LTD., Tokyo (JP)

(72) Inventors: Natsuko Sato, Tokyo (JP); Takashi Nakajima, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 121 days.

(21) Appl. No.: 15/937,268

(22) Filed: Mar. 27, 2018

(65) Prior Publication Data

US 2018/0323005 A1 Nov. 8, 2018

(30) Foreign Application Priority Data

May 2, 2017 (JP) ..... JP2017-091695

(51) Int. Cl.
*H01F 5/00* (2006.01)
*H01F 27/32* (2006.01)
(Continued)

(52) U.S. Cl.
CPC ..... *H01F 27/32* (2013.01); *H01F 17/0013* (2013.01); *H01F 27/2804* (2013.01);
(Continued)

(58) Field of Classification Search
USPC ..... 336/200
See application file for complete search history.

(56) References Cited

U.S. PATENT DOCUMENTS 5,552,756 A * 9/1996 Ushiro ..... H01F 17/0013 336/200
2003/0134612 A1 7/2003 Nakayama et al.
(Continued)

FOREIGN PATENT DOCUMENTS

| | | | |
|---|---|---|---|
| JP | 2016-131208 | A | 7/2016 |
| WO | 01/67470 | A1 | 9/2001 |
| WO | 2014/136342 | A1 | 9/2014 |

OTHER PUBLICATIONS

Notice of Reasons for Refusal dated Mar. 30, 2021, issued in corresponding Japanese Patent Application No. 2017-091695 with English translation (7 pgs.).

*Primary Examiner* — Ronald Hinson
(74) *Attorney, Agent, or Firm* — Pillsbury Winthrop Shaw Pittman, LLP

(57) ABSTRACT

One object of the present invention is to provide a magnetic coupling coil component having a high coupling coefficient between coils of different lines and facilitating insulation between the coils. A coil component according to one embodiment includes: an insulator body including first insulating layers and second insulating layers stacked together in a lamination direction; first conductive patterns formed on the first insulating layers; and second conductive patterns formed on the second insulating layers. The insulator body includes a first end region, a second end region, and an intermediate region positioned between the first end region and the second end region. The first end region includes the first insulating layers only, the second end region includes the second insulating layers only, and the intermediate region includes the first insulating layers and the second insulating layers arranged alternately in the lamination direction.

13 Claims, 2 Drawing Sheets

(51) Int. Cl.
*H01F 27/28* (2006.01)
*H01F 27/29* (2006.01)
*H01F 17/00* (2006.01)

(52) U.S. Cl.
CPC ... *H01F 27/292* (2013.01); *H01F 2017/0066* (2013.01); *H01F 2017/0073* (2013.01); *H01F 2027/2809* (2013.01)

(56) References Cited

U.S. PATENT DOCUMENTS

2014/0253277 A1* 9/2014 Takezawa ..... H01F 27/2804
336/200
2015/0332840 A1 11/2015 Yazaki

* cited by examiner

MAGNETIC COUPLING COIL COMPONENT

CROSS-REFERENCE TO RELATED APPLICATIONS

This application is based on and claims the benefit of priority from Japanese Patent Application Serial No. 2017-91695 (filed on May 2, 2017), the contents of which are hereby incorporated by reference in their entirety.

TECHNICAL FIELD

The present invention relates to a coil component, and in particular to a magnetic coupling coil component including a pair of coil conductors magnetically coupled to each other. In further particular, the present invention relates to a magnetic coupling coil component produced by a lamination process.

BACKGROUND

A magnetic coupling coil component includes a pair of coil conductors magnetically coupled to each other. Examples of magnetic coupling coil component including a pair of coil conductors magnetically coupled to each other include a common mode choke coil, a transformer, and a coupling inductor. In most cases, such a magnetic coupling coil component preferably has a high coupling coefficient between the pair of coil conductors.

Magnetic coupling coil components produced by a lamination process are disclosed in Japanese Patent Application Publication No. 2016-131208 ("the '208 Publication") and International Publication No. WO 2014/136342 ("the '342 Publication").

The coupling coil component disclosed in the '208 Publication includes a plurality of coil units embedded in an insulator. The plurality of coil units are configured such that the winding axes of the coil conductors of the coil units are substantially aligned with each other and the coil units are tightly contacted with each other, thereby increasing the degree of coupling between the coil conductors.

In the magnetic coupling coil component disclosed in the '208 Publication, a leakage magnetic flux passing between the two coil conductors causes a leakage inductance. The leakage inductance degrades the coupling coefficient in the magnetic coupling coil component.

In the coupling coil component disclosed in the '342 Publication, a coil conductor of a first line extends across a plurality of insulating layers, and a coil conductor of a second line extends across a plurality of insulating layers other than those across which the coil conductor of the first line extends. In this coupling coil component, the layers of the coil conductor of the first line and the layers of the coil conductor of the second line are arranged alternately along the lamination direction, thereby increasing the degree of coupling between the two lines.

In the coupling coil component disclosed in the '342 Publication, the coil conductors of different lines are separated by only the thickness of one insulating layer. Depending on the directions of the electric current flowing through the coil conductors of both lines, the potential difference is large between the coil conductors arranged on adjacent insulating layers. Therefore, it is difficult to ensure insulation between coil conductors of different lines.

SUMMARY

One particular object of the present invention is to improve magnetic coupling coil components.

One particular object of the present invention is to provide a magnetic coupling coil component having a high coupling coefficient between coils of different lines and facilitating insulation between the coils.

Other objects of the present invention will be apparent with reference to the entire description in this specification.

A coil component according to one embodiment of the present invention comprises: an insulator body including a plurality of first insulating layers and a plurality of second insulating layers stacked together in a lamination direction; a plurality of first conductive patterns formed on the plurality of first insulating layers; and a plurality of second conductive patterns formed on the plurality of second insulating layers. The insulator body includes a first end region positioned at a top in the lamination direction, a second end region positioned at a bottom in the lamination direction, and an intermediate region positioned between the first end region and the second end region. The first end region includes one or more of the plurality of first insulating layers only, the second end region includes one or more of the plurality of second insulating layers only, and the intermediate region includes other one or more of the plurality of first insulating layers and other one or more of the plurality of second insulating layers arranged alternately in the lamination direction.

The above description that the first end region includes "only" the first insulating layers means that the first end region includes insulating layers included in the plurality of first insulating layers but does not include insulating layers included in the plurality of second insulating layers. In other words, the first end region does not include insulating layers included in the plurality of second insulating layers. As a result, the first end region also does not include the plurality of second conductive patterns formed on the plurality of second insulating layers. As for the members other than the insulating layers, the first end region may include members other than the first insulating layers. For example, the first end region may include the first conductive patterns formed on the first insulating layers and via electrodes connecting between the first conductive patterns.

The above description that the second end region includes "only" the second insulating layers is also focused on the insulating layers, as described for the first end region. That is, the above description that the second end region includes "only" the second insulating layers means that the second end region includes insulating layers included in the plurality of second insulating layers but does not include insulating layers included in the plurality of first insulating layers.

In this embodiment, the first end region includes the first conductive patterns but does not include the second conductive patterns, and the second end region includes the second conductive patterns but does not include the first conductive patterns. The potential difference between the conductive patterns of the same line provided on adjacent insulating layers (that is, the potential difference between the first conductive patterns and the potential difference between the second conductive patterns) is ordinarily not so large as to cause dielectric breakdown, and therefore, the first end region and the second end region are hardly subject to dielectric breakdown.

In the intermediate region, adjacent insulating layers have formed thereon conductive patterns of different lines. Therefore, it is desirable to improve the insulation quality between the adjacent insulating layers. For example, the thickness of the insulating layers included in the intermediate region can be increased to improve the insulation quality between adjacent conductive patterns included in the intermediate region. According to the above embodiment, when the insulating layers are thickened to improve the insulation quality, it is only required to increase the thickness of the insulating layers included in the intermediate region. This preserves a low profile as compared to the case where the whole insulating layers are thickened.

In the above embodiment, the intermediate region includes the first insulating layers and the second insulating layers arranged alternately in the lamination direction. Thus, in the intermediate region, the first conductive patters and the second conductive patterns are disposed on adjacent insulating layers. Therefore, the coupling coefficient between the coil including the first conductive patterns and the coil including the second conductive patterns can be increased.

A coil component according to one embodiment of the present invention further comprises: one or more first via conductive members connecting between the plurality of first conductive patterns; and one or more second via conductive members connecting between the plurality of second conductive patterns.

A coil component according to one embodiment of the present invention comprises: a first external electrode electrically connected to a first end portion of a first coil unit, the first coil unit including the plurality of first conductive patterns and the one or more first via conductive members; a second external electrode electrically connected to a second end portion of the first coil unit a third external electrode electrically connected to a first end portion of a second coil unit, the second coil unit including the plurality of second conductive patterns and the one or more second via conductive members; and a fourth external electrode electrically connected to a second end portion of the second coil unit. In this embodiment, the second end portion of the first coil unit and the first end portion of the second coil unit are disposed in the intermediate region. In this embodiment, the first coil unit is arranged such that a voltage having a first electric potential is supplied from the second external electrode to the second end portion of the first coil unit, and the second coil unit is arranged such that a voltage having the first electric potential is supplied from the third external electrode to the first end portion of the second coil unit.

In this embodiment, the potential difference between the first coil unit and the second coil unit is small in the intermediate region. Thus, in the intermediate region, insulation between the first coil unit and the second coil unit can be readily ensured.

Various embodiments of the invention disclosed herein provide a magnetic coupling coil component having a high coupling coefficient between coils of different lines and facilitating insulation between the coils.

DESCRIPTION OF THE EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear in accurate scales, for convenience of description.

Figure 1:
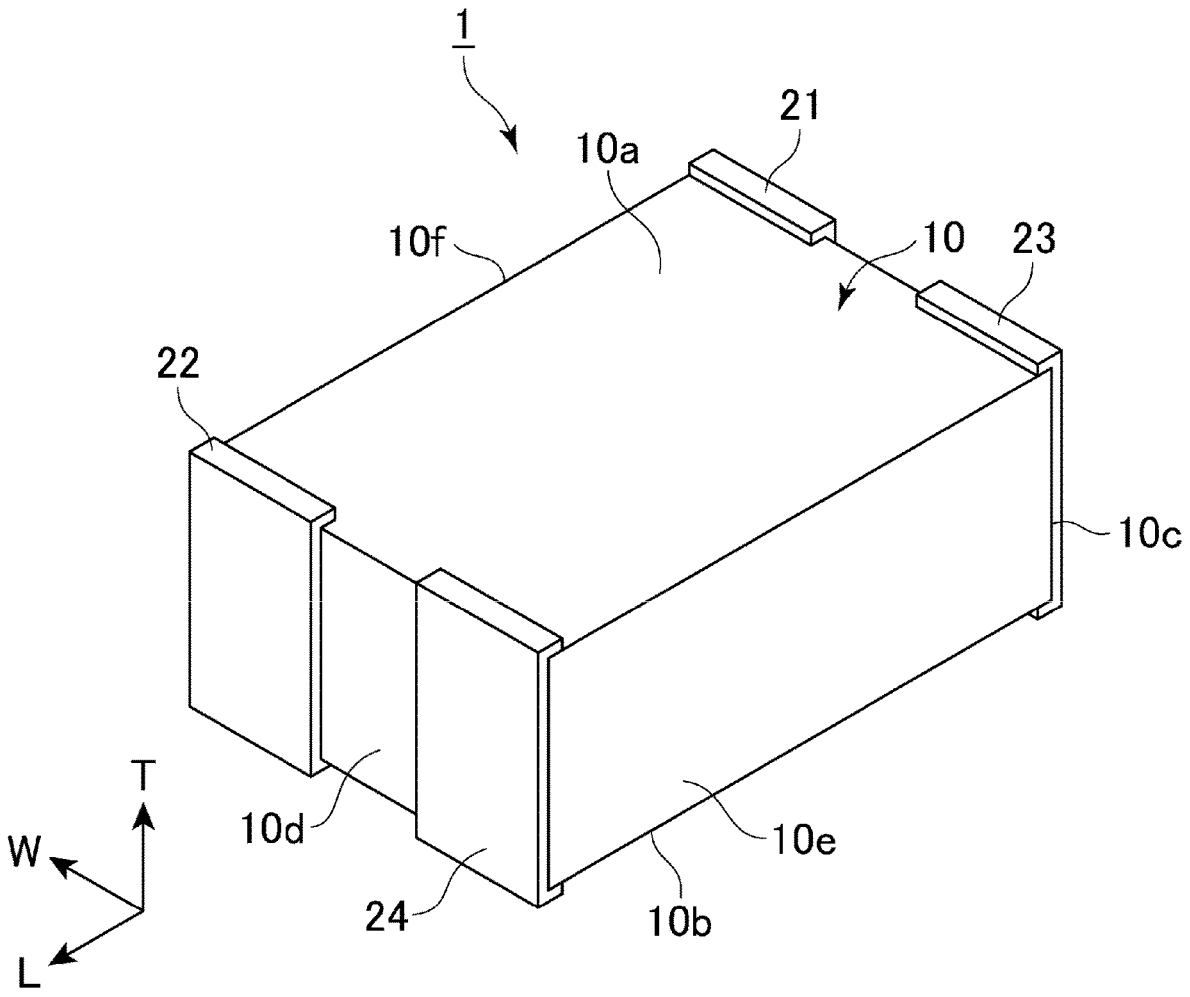
FIG. 1 is a perspective view of a coil component according to one embodiment of the present invention.
Figure 2:
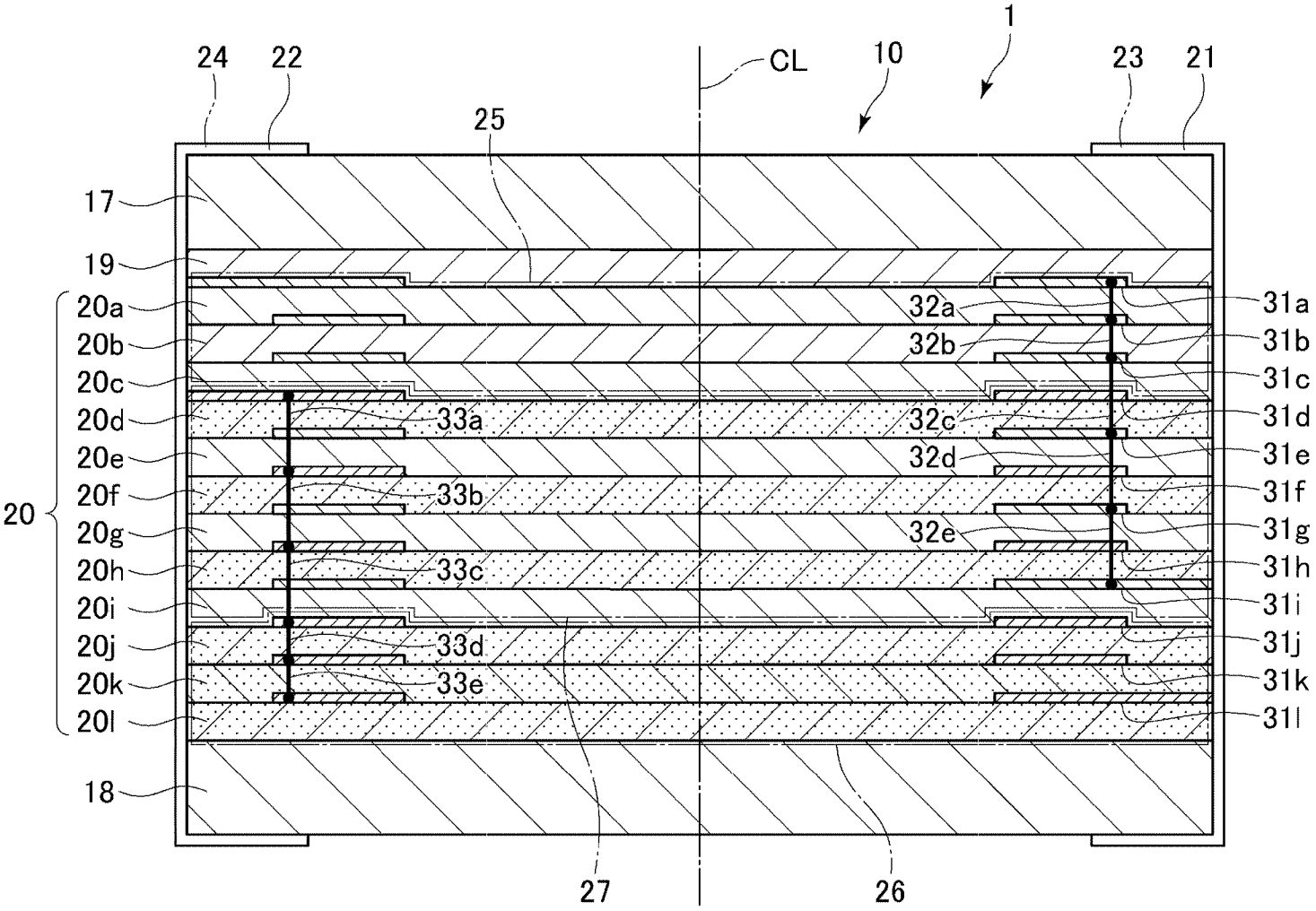
FIG. 2 is a schematic perspective view of the interior of the coil component of FIG. 1 as viewed from the front.

A coil component 1 according to one embodiment of the present invention will be hereinafter described with reference to FIGS. 1 and 2. FIG. 1 is a perspective view of the coil component 1 according to one embodiment of the present invention, and FIG. 2 is a schematic perspective view of the interior of the coil component of FIG. 1 as viewed from the front.

The coil component 1 shown in these drawings is a laminated magnetic coupling coil component produced by a lamination process or a thin film process. The coil component 1 may be used as a transformer, a coupling inductor, or other various coil components, in addition to a common mode choke coil.

The coil component 1 includes an insulator body 10 made of a magnetic material having an excellent insulation quality, a first coil unit embedded in the insulator body 10, a second coil unit embedded in the insulator body 10, an external electrode 21 electrically connected to one end of the first coil unit, an external electrode 22 electrically connected to the other end of the first coil unit, an external electrode 23 electrically connected to one end of the second coil unit, and an external electrode 24 electrically connected to the other end of the second coil unit. The first coil unit and the second coil unit will be described later.

The insulator body 10 has a substantially rectangular parallelepiped shape. The insulator body 10 has a first principal surface 10*a*, a second principal surface 10*b*, a first end surface 10*c*, a second end surface 10*d*, a first side surface 10*e*, and a second side surface 10*f*. The outer surface of the insulator body 10 is defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other.

In FIG. 1, the first principal surface 10*a* lies on the top side of the insulator body 10, and therefore, the first principal surface 10*a* may be herein referred to as "the top surface." Similarly, the second principal surface 10*b* may be referred to as "the bottom surface." The coil component 1 is disposed such that the second principal surface 10*b* is opposed to a circuit board (not shown), and therefore, the second principal surface 10*b* may be herein referred to as "the mounting surface." Furthermore, the top-bottom direction of the coil component 1 refers to the top-bottom direction in FIG. 1.

For convenience in description, the first side surface 10*e* is supposed to be the front surface of the coil component 1. FIG. 2 shows the interior of the coil component 1 as viewed from the first side surface 10*e* of the coil component 1.

In this specification, the "length" direction, the "width" direction, and the "thickness" direction of the coil component 1 refers to the "L" direction, the "W" direction, and the "T" direction in FIG. 1, respectively, unless otherwise construed from the context.

The external electrode 21 and the external electrode 23 are provided on the first end surface 10*c* of the insulator body 10. The external electrode 22 and the external electrode 24 are provided on the second end surface 10*d* of the insulator body 10. As shown, these external electrodes extend to the top surface 10*a* and the bottom surface 10*b* of the insulator body 10.

As shown in FIG. 2, the insulator body 10 includes an insulator portion 20, a top cover layer 17 provided on the top surface of the insulator portion 20, and a bottom cover layer 18 provided on the bottom surface of the insulator portion 20.

The insulator portion 20 includes an insulating layer 19 and insulating layers 20*a* to 20*l* stacked together. The insulator portion 20 includes the top cover layer 17, the insulating layer 19, the insulating layer 20*a*, the insulating layer 20*b*, the insulating layer 20*c*, the insulating layer 20*d*, the insulating layer 20*e*, the insulating layer 20*f*, the insulating layer 20*g*, the insulating layer 20*h*, the insulating layer 20*i*, the insulating layer 20*j*, the insulating layer 20*k*, the insulating layer 20*l*, and the bottom cover layer 18 that are stacked together in this order from the positive side to the negative side with respect to the direction of the axis T.

In one embodiment of the present invention, the insulating layer 19 and the insulating layers 20*a* to 20*l* contain a resin and a large number of filler particles. The filler particles are dispersed in the resin. The insulating layers 20*a* to 20*l* may not contain the filler particles.

The top cover layer 17 is a laminate including a plurality of insulating layers stacked together. Similarly, the bottom cover layer 18 is a laminate including a plurality of insulating layers stacked together. Each of the insulating layers constituting the top cover layer 17 and the bottom cover layer 18 is made of a resin containing a large number of filler particles dispersed therein. These insulating layers may not contain the filler particles.

The resin contained in the insulating layer 19, the insulating layers 20*a* to 20*l*, the insulating layers constituting the top cover layer 17, and the insulating layers constituting the bottom cover layer 18 is a thermosetting resin having an excellent insulation quality. Examples of such a resin include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The resin contained in one layer is either the same as or different from the resin contained in another layer.

The filler particles contained in the insulating layer 19, the insulating layers 20*a* to 20*l*, the insulating layers constituting the top cover layer 17, and the insulating layers constituting the bottom cover layer 18 are particles of a ferrite material, metal magnetic particles, particles of an inorganic material such as $SiO_2$ or $Al_2O_3$, or glass-based particles.

On the top surfaces of the insulating layers 20*a* to 20*l*, there are provided conductive patterns 31*a* to 31*l*, respectively. The conductive patterns 31*a* to 31*l* are formed by, for example, printing a conductive paste made of a metal or alloy having an excellent electrical conductivity by screen printing. The conductive paste may be made of Ag, Pd, Cu, Al, or an alloy thereof. The conductive patterns 31*a* to 31*l* may be formed by other methods using other materials.

The conductive patterns 31*a* to 31*l* extend around the coil axis CL. Each of the conductive patterns 31*a* to 31*l* has a partially cut shape. Therefore, each of the conductive patterns 31*a* to 31*l* has a pair of end portions. Each of the conductive patterns 31*a* to 31*l* has, for example, a C-shape or a U-shape in a planar view.

One of the end portions of the conductive pattern 31*a* extends to the second end surface 10*d* of the insulating body 10 to be electrically connected to the external electrode 22. One of the end portions of the conductive pattern 31*i* extends to the first end surface 10*c* of the insulating body 10 to be electrically connected to the external electrode 21.

One of the end portions of the conductive pattern 31*d* extends to the second end surface 10*d* of the insulating body 10 to be electrically connected to the external electrode 24. One of the end portions of the conductive pattern 31*l* extends to the first end surface 10*c* of the insulating body 10 to be electrically connected to the external electrode 23.

At predetermined positions in the insulating layers 20*a* to 20*h*, there are formed via conductive members 32*a* to 32*e*. The via conductive members 32*a* to 32*e* are formed by drilling through-holes at predetermined positions in the insulating layers 20*a* to 20*h* so as to extend in the direction of axis T and embedding a conductive paste into the through-holes.

As described above, one of the end portions of the conductive pattern 31*a* is connected to the external electrode 22. The via conductive member 32*a* electrically connects between the end portion of the conductive pattern 31*a* opposite to the end portion thereof connected to the external electrode 22 and one of the end portions of the conductive pattern 31*b*.

The via conductive member 32*b* electrically connects between the other of the end portions of the conductive pattern 31*b* and one of the end portions of the conductive pattern 31*c*. The via conductive member 32*c* electrically connects between the other of the end portions of the conductive pattern 31*c* and one of the end portions of the conductive pattern 31*e*. The via conductive member 32*d* electrically connects between the other of the end portions of the conductive pattern 31*e* and one of the end portions of the conductive pattern 31*g*.

As described above, one of the end portions of the conductive pattern 31*i* is connected to the external electrode 21. The via conductive member 32*e* electrically connects between the other of the end portions of the conductive pattern 31*g* and the end portion of the conductive pattern 31*i* opposite to the end portion thereof connected to the external electrode 21.

At predetermined positions in the insulating layers 20*d* to 20*k*, there are formed via conductive members 33*a* to 33*e*. The via conductive members 33*a* to 33*e* are formed by drilling through-holes at predetermined positions in the insulating layers 20*d* to 20*k* so as to extend in the direction of axis T and embedding a conductive paste into the through-holes.

As described above, one of the end portions of the conductive pattern 31*d* is connected to the external electrode 24. The via conductive member 33*a* electrically connects between the end portion of the conductive pattern 31*d* opposite to the end portion thereof connected to the external electrode 24 and one of the end portions of the conductive pattern 31*f*.

The via conductive member 33*b* electrically connects between the other of the end portions of the conductive pattern 31*f* and one of the end portions of the conductive pattern 31*h*. The via conductive member 33*c* electrically connects between the other of the end portions of the conductive pattern 31*h* and one of the end portions of the conductive pattern 31*j*. The via conductive member 33*d* electrically connects between the other of the end portions of the conductive pattern 31*j* and one of the end portions of the conductive pattern 31*k*.

As described above, one of the end portions of the conductive pattern 31*l* is connected to the external electrode 23. The via conductive member 33*e* electrically connects between the other of the end portions of the conductive pattern 31*k* and the end portion of the conductive pattern 31*l* opposite to the end portion thereof connected to the external electrode 23.

As described above, between the external electrode 22 and the external electrode 21, there is provided a first coil unit including the conductive pattern 31*a*, the via conductive member 32*a*, the conductive pattern 31*b*, the via conductive member 32*b*, the conductive pattern 31*c*, the via conductive member 32*c*, the conductive pattern 31*e*, the via conductive member 32*d*, the conductive pattern 31*g*, the via conductive member 32*e*, and the conductive pattern 31*i*.

The insulating layers included in the first coil unit may be herein referred to as the first insulating layers. For example, in the embodiment shown in FIG. 2, the first insulating layers include the insulating layers 20*a*, 20*b*, 20*c*, 20*e*, 20*g*, 20*i*.

The conductive patterns included in the first coil unit may be herein referred to as the first conductive patterns. For example, in the embodiment shown in FIG. 2, the first conductive patterns include the conductive patterns 31*a*, 31*b*, 31*c*, 31*e*, 31*g*, 31*i*.

Between the external electrode 24 and the external electrode 23, there is provided a second coil unit including the conductive pattern 31*d*, the via conductive member 33*a*, the conductive pattern 31*f*, the via conductive member 33*b*, the conductive pattern 31*h*, the via conductive member 33*c*, the conductive pattern 31*j*, the via conductive member 33*d*, the conductive pattern 31*k*, the via conductive member 33*e*, and the conductive pattern 31*l*.

The insulating layers included in the second coil unit may be herein referred to as the second insulating layers. For example, in the embodiment shown in FIG. 2, the second insulating layers include the insulating layers 20*d*, 20*f*, 20*h*, 20*j*, 20*k*, 20*l*.

The conductive patterns included in the second coil unit may be herein referred to as the second conductive patterns. For example, in the embodiment shown in FIG. 2, the second conductive patterns include the conductive patterns 31*d*, 31*f*, 31*h*, 31*j*, 31*k*, 31*l*.

The insulator body 10 is divided into a top region 25, a bottom region 26, and an intermediate region 27 interposed between the top region 25 and the bottom region 26.

The top region 25 includes the insulating layers 20*a*, 20*b*, 20*c* and the conductive patterns 31*a*, 31*b*, 31*c*. The top end of the top region 25 is in contact with the bottom surface of the top cover layer 17.

The bottom region 26 includes the insulating layers 20*j*, 20*k*, 20*l* and the conductive patterns 31*j*, 31*k*, 31*l*. The bottom end of the bottom region 26 is in contact with the top surface of the bottom cover layer 18.

The intermediate region 27 includes the insulating layers 20*d*, 20*e*, 20*f*, 20*g*, 20*h*, 20*i* and the conductive patterns 31*d*, 31*e*, 31*f*, 31*g*, 31*h*, 31*i*. The top end of the intermediate region 27 is in contact with the bottom end of the top region 25, and the bottom end of the intermediate region 27 is in contact with the top end of the bottom region 26.

The top region 25 includes only the conductive patterns of the first coil unit (specifically, the conductive patterns 31*a*, 31*b*, 31*c*) among the conductive patterns 31*a* to 31*l* embedded in the insulator body 10. The top region 25 includes only the insulating layers having formed thereon the conductive patterns of the first coil unit (specifically, the insulating layers 20*a*, 20*b*, 20*c*) among the insulating layers 20*a* to 20*l* constituting the insulator portion 20.

The top region 25 includes the conductive patterns 31*a*, 31*b*, 31*c* of the first coil unit but does not include the second conductive patterns of the second coil unit. The potential difference between the conductive patterns of the first coil unit is ordinarily not so large as to cause dielectric breakdown, and therefore, the top region 25 is hardly subject to dielectric breakdown.

The bottom region 26 includes only the conductive patterns of the second coil unit (specifically, the conductive patterns 31*j*, 31*k*, 31*l*) among the conductive patterns 31*a* to 31*l* embedded in the insulator body 10. The bottom region 26 includes only the insulating layers having formed thereon the conductive patterns of the second coil unit (specifically, the insulating layers 20*j*, 20*k*, 20*l*) among the insulating layers 20*a* to 20*l* constituting the insulator portion 20.

The bottom region 26 includes the conductive patterns 31*j*, 31*k*, 31*l* of the second coil unit but does not include the first conductive patterns of the first coil unit. The potential difference between the conductive patterns of the second coil unit is ordinarily not so large as to cause dielectric breakdown, and therefore, the bottom region 26 is hardly subject to dielectric breakdown.

The intermediate region 27 includes the insulating layers having formed thereon the conductive patterns of the first coil unit and the insulating layers having formed thereon the conductive patterns of the second coil unit, among the conductive patterns 31*a* to 31*l* embedded in the insulator body 10, and these insulating layers are arranged alternately in the lamination direction (the direction parallel to the coil axis CL). In the embodiment shown in FIG. 2, the intermediate region 27 includes the insulating layer 20*d* having formed thereon the conductive pattern 31*d*, the insulating layer 20*e* having formed thereon the conductive pattern 31*e*, the insulating layer 20*f* having formed thereon the conductive pattern 31*f*, the insulating layer 20*g* having formed thereon the conductive pattern 31*g*, the insulating layer 20*h* having formed thereon the conductive pattern 31*h*, and the insulating layer 20*i* having formed thereon the conductive pattern 31*i*, and these insulating layers are arranged in this order from the top to the bottom with respect to the lamination direction of the intermediate region 27. In this arrangement, the conductive patterns 31*d*, 31*f*, 31*h* are included in the first coil unit, and the conductive patterns 31*e*, 31*g*, 31*i* are included in the second coil unit.

As described above, the intermediate region 27 includes the insulating layers 20*d*, 20*f*, 20*h* having formed thereon the conductive patterns 31*d*, 31*f*, 31*h* of the first coil unit, respectively, and the insulating layers 20*e*, 20*g*, 20*i* having formed thereon the conductive patterns 31*e*, 31*g*, 31*i* of the second coil unit, respectively, and these insulating layers are arranged alternately in the lamination direction. Thus, in the intermediate region 27, the first conductive patters and the second conductive patterns are disposed on adjacent insulating layers, thereby increasing the coupling coefficient between the first coil unit and the second coil unit.

One end portion of the first coil unit (the end portion of the conductive pattern 31*a*) is connected to the external electrode 22, and the other end portion of the first coil unit (the end portion of the conductive pattern 31*i*) is connected to the external electrode 21. Thus, in the embodiment shown, one end portion of the first coil unit is disposed in the top region 25, and the other end portion of the first coil unit is disposed in the intermediate region 27.

One end portion of the second coil unit (the end portion of the conductive pattern 31*d*) is connected to the external electrode 24, and the other end portion of the second coil unit (the end portion of the conductive pattern 31*l*) is connected to the external electrode 23. Thus, in the embodiment shown, one end portion of the second coil unit is disposed in the intermediate region 27, and the other end portion of the second coil unit is disposed in the bottom region 26.

In one embodiment of the present invention, the coil component 1 is mounted on an electronic circuit (not shown) such that an electric current flows from the external electrode 22 through the first coil unit to the external electrode 21 and an electric current flows from the external electrode 23 through the second coil unit to the external electrode 24. The electric potential of the voltage supplied from the external electrode 22 to the end portion of the first coil unit disposed in the top region 25 (the end portion of the conductive pattern 31*a*) is equal to the electric potential of the voltage supplied from the external electrode 23 to the end portion of the second coil unit disposed in the bottom region 26 (the end portion of the conductive pattern 31*l*). Thus, in one embodiment of the present invention, the first coil unit and the second coil unit are configured and arranged such that the electric potential of the voltage supplied from the external electrode 22 to one end portion of the first coil unit is equal to the electric potential of the voltage supplied from the external electrode 23 to one end portion of the second coil unit.

The electric potential of the first coil unit in the intermediate region 27 is lower than the electric potential of the voltage supplied from the external electrode 22 due to a voltage drop in the conductive patterns of the first coil unit disposed in the top region 25 (the conductive patterns 31*a*, 31*b*, 31*c*). Similarly, the electric potential of the second coil unit in the intermediate region 27 is lower than the electric potential of the voltage supplied from the external electrode 23 due to a voltage drop in the conductive patterns of the second coil unit disposed in the bottom region 26 (the conductive patterns 31*j*, 31*k*, 31*l*). Therefore, in the above embodiment, the potential difference between the first coil unit and the second coil unit is small in the intermediate region 27. Thus, in the intermediate region 27, insulation between the first coil unit and the second coil unit can be readily ensured.

In the coil component 1, the number of the conductive patterns and the insulating layers stacked in the intermediate region 27 can be increased to further increase the coupling coefficient. Therefore, the coupling coefficient can be readily adjusted.

Next, a description is given of an example of a production method of the coil component 1. The coil component 1 can be produced by, for example, a lamination process. More specifically, the first step is to produce the insulating layer 19, the insulating layers 20*a* to 20*l*, the insulating layers constituting the top cover layer 17, and the insulating layers constituting the bottom cover layer 18.

More specifically, to produce these insulating layers, a thermosetting resin (e.g., epoxy resin) having filler particles dispersed therein is mixed with a solvent to produce a slurry. The slurry is applied to a surface of a base film made of a plastic and dried, and the dried slurry is cut to a predetermined size to obtain magnetic sheets to be used as the insulating layer 19, the insulating layers 20*a* to 20*l*, the insulating layers constituting the top cover layer 17, and the insulating layers constituting the bottom cover layer 18.

Next, through-holes are formed at predetermined positions in the magnetic sheets to be used as the insulating layers 20*a* to 20*k* so as to extend through the magnetic sheets in the direction of axis T.

Next, a conductive paste made of a metal material (e.g. Ag) is printed by screen printing on the top surfaces of the magnetic sheets to be used as the insulating layers 20*a* to 20*l*, so as to form the conductive patterns 31*a* to 31*l*, and the metal paste is buried into the through-holes formed in the magnetic sheets to form the via conductive members 32*a* to 32*e* and the via conductive members 33*a* to 33*e*.

Next, the magnetic sheets to be used as the insulating layers 20*a* to 20*l* are stacked together to obtain a coil laminate to be used as the insulator portion 20. Next, the magnetic sheets for the top cover layer 17 are stacked together to from a top cover layer laminate that corresponds to the top cover layer 17, and the magnetic sheets for the bottom cover layer 18 are stacked together to from a bottom cover layer laminate that corresponds to the bottom cover layer 18.

Next, the bottom cover layer laminate to be used as the bottom cover layer 18, the coil laminate to be used as the insulator portion 20, the magnetic sheet to be used as the insulating layer 19, and the top cover layer laminate to be used as the top cover layer 17 are stacked together and bonded together by thermal compression using a pressing machine to obtain a body laminate.

Next, the body laminate is segmented into units of a desired size by using a cutter such as a dicing machine and a laser processing machine to obtain a chip laminate corresponding to the insulator body 10. Next, the chip laminate is degreased and then heated.

Next, a conductive paste is applied to both end portions of the heated chip laminate to form the external electrode 21, the external electrode 22, the external electrode 23, and the external electrode 24. Thus, the coil component 1 is obtained.

The dimensions, materials, and arrangements of the various constituents described in this specification are not limited to those explicitly described for the embodiments, and the various constituents can be modified to have any dimensions, materials, and arrangements within the scope of the present invention. The constituents other than those explicitly described herein can be added to the described embodiments; and part of the constituents described for the embodiments can be omitted.

What is claimed is:

1. A coil component, comprising: an insulator body including a plurality of first insulating layers and a plurality of second insulating layers stacked together in a lamination direction; a plurality of first conductive patterns formed on the plurality of first insulating layers; a plurality of second conductive patterns formed on the plurality of second insulating layers; one or more first via conductive members connecting between the plurality of first conductive patterns; and wherein at least one of said one or more first via conductive members is configured to penetrate at least one of said plurality of first insulating layers and at least one of said plurality of second insulating layers, wherein the insulator body includes a first end region positioned at a top in the lamination direction, a second end region positioned at a bottom in the lamination direction, and an intermediate region positioned between the first end region and the second end region, wherein the first end region includes two or more of the plurality of first insulating layers only, wherein the second end region includes two or more of the plurality of second insulating layers only, wherein the intermediate region includes other one or more of the plurality of first insulating layers and other one or more of the plurality of second insulating layers arranged alternately in the lamination direction, and wherein the plurality of first conductive patterns are electrically insulated from the plurality of second conductive patterns.

2. The coil component of claim 1, further comprising:

a first external electrode electrically connected to a first end portion of a first coil unit, the first coil unit including the plurality of first conductive patterns;

a second external electrode electrically connected to a second end portion of the first coil unit;

a third external electrode electrically connected to a first end portion of a second coil unit, the second coil unit including the plurality of second conductive patterns; and a fourth external electrode electrically connected to a second end portion of the second coil unit, wherein the second end portion of the first coil unit and the first end portion of the second coil unit are disposed in the intermediate region, the first coil unit is arranged such that a voltage having a first electric potential is supplied from the second external electrode to the second end portion of the first coil unit, and the second coil unit is arranged such that a voltage having the first electric potential is supplied from the third external electrode to the first end portion of the second coil unit.

3. The coil component of claim 1, further comprising:

one or more second via conductive members connecting between the plurality of second conductive patterns.

4. The coil component of claim 1, wherein a first layer in the intermediate region adjacent the first end region is a second insulating layer.

5. The coil component of claim 4, wherein a first layer in the intermediate region adjacent the second end region is a first insulating layer.

6. The coil component of claim 2, further comprising one or more second via conductive members connecting between the plurality of second conductive patterns, wherein the one or more first via conductive members are provided adjacent a first end of the insulator body and the one or more second via conductive members are provided adjacent a second end of the insulator body, the second end being opposite of the first end.

7. The coil component of claim 6, wherein each first via conductive member electrically connects between (a) an end portion of the one of the plurality of first conductive patterns opposite to an end portion thereof that is connected to the second external electrode and (b) an end portion of a next one of the plurality of first conductive patterns.

8. The coil component of claim 7, wherein each second via conductive member electrically connects between (a) an end portion of the one of the plurality of first conductive patterns opposite to an end portion thereof that is connected to the fourth external electrode and (b) an end portion of one of the plurality of first conductive patterns.

9. A coil component, comprising:

an insulator body including a plurality of first insulating layers and a plurality of second insulating layers stacked together in a lamination direction;

the insulator body including a first end region positioned at a top in the lamination direction, a second end region positioned at a bottom in the lamination direction, and an intermediate region positioned between the first end region and the second end region, the first end region including two or more of the plurality of first insulating layers only, the second end region including two or more of the plurality of second insulating layers only; a first, top layer in the intermediate region directly adjacent the first end region being one of the second insulating layers, a second, bottom layer in the intermediate region directly adjacent the second end region being one of the first insulating layers, and wherein the intermediate region includes alternating first insulating layers and second insulating layers between the first, top layer and the second, bottom layer in the lamination direction; a plurality of first conductive patterns formed on the plurality of first insulating layers; a plurality of second conductive patterns formed on the plurality of second insulating layers; one or more first via conductive members connecting between the plurality of first conductive patterns and extending into the first end region and the intermediate region; and one or more second via conductive members connecting between the plurality of second conductive patterns and extending into the intermediate region and the second end regions, wherein at least one of said one or more first via conductive members is configured to penetrate at least one of said plurality of first insulating layers and at least one of said plurality of second insulating layers.

10. The coil component of claim 9, wherein the first end region has three first insulating layers.

11. The coil component of claim 10, wherein the second end region has three second insulating layers.

12. The coil component of claim 9, wherein the second end region has three second insulating layers.

13. The coil component of claim 9, further comprising;

a first external electrode electrically connected to a first end portion of a first coil unit, the first coil unit including the plurality of first conductive patterns;

a second external electrode electrically connected to a second end portion of the first coil unit;

a third external electrode electrically connected to a first end portion of a second coil unit, the second coil unit including the plurality of second conductive patterns; and a fourth external electrode electrically connected to a second end portion of the second coil unit, wherein the second end portion of the first coil unit and the first end portion of the second coil unit are disposed in the intermediate region, the first coil unit is arranged such that a voltage having a first electric potential is supplied from the second external electrode to the second end portion of the first coil unit, and the second coil unit is arranged such that a voltage having the first electric potential is supplied from the third external electrode to the first end portion of the second coil unit.

* * * * *